US009011035B2

(12) United States Patent
Munro

(10) Patent No.: US 9,011,035 B2
(45) **Date of Patent: *Apr. 21, 2015**

(54) INTEGRATED FRAME AND COVER SYSTEM

(71) Applicant: Munro Ltd., Utopia, Ontario (CA)

(72) Inventor: John Munro, King (CA)

(73) Assignee: Munro Ltd., Utopia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/045,480

(22) Filed: Oct. 3, 2013

(65) Prior Publication Data

US 2014/0037374 A1 Feb. 6, 2014

Related U.S. Application Data

(63) Continuation of application No. 12/292,228, filed on Nov. 14, 2008, now Pat. No. 8,573,883.

(51) Int. Cl.
*E02D 29/14* (2006.01)
*E02D 29/12* (2006.01)

(52) U.S. Cl.
CPC ..... *E02D 29/1409* (2013.01); *E02D 29/12* (2013.01); *E02D 29/14* (2013.01)

(58) Field of Classification Search
USPC ..... 404/25, 26; 277/628, 630, 637
See application file for complete search history.

(56) References Cited

U.S. PATENT DOCUMENTS

| | | | | |
|---|---|---|---|---|
| 689,224 | A * | 12/1901 | Pillsbury | 404/26 |
| 3,294,000 | A | 12/1966 | Pelsue | |
| 3,331,295 | A * | 7/1967 | Sorrell | 404/26 |
| 3,858,998 | A | 1/1975 | Larsson et al. | |
| 3,930,739 | A | 1/1976 | Larsson et al. | |
| 4,075,796 | A | 2/1978 | Cuozzo | |
| 4,149,816 | A | 4/1979 | Piso | |
| 4,197,031 | A | 4/1980 | Hild | |

(Continued)

FOREIGN PATENT DOCUMENTS

| | | |
|---|---|---|
| CA | 2188202 A1 | 4/1998 |
| GB | 2 270 708 A | 3/1994 |

OTHER PUBLICATIONS

"Adjustable Catchbasin and Manhole Covers," Engineering News and American Railway Journal, vol. XLVI, No. 2 (Jul. 11, 1901), p. 30.

(Continued)

*Primary Examiner* — Abigail A Risic
(74) *Attorney, Agent, or Firm* — Hoffmann & Baron, LLP

(57) ABSTRACT

A system and method are provided for coupling a manhole cover to an underground utility box to support the manhole cover substantially flush with a ground surface such as a roadway. A holder couples to an underground utility box and includes upper and lower ends and a channel extending therebetween, and a support structure extending into the channel and defining an upwardly facing support surface. An adjustment member for coupling to a manhole cover is inserted within the channel, and includes upper and lower ends, and a passageway extending therebetween and communicating with the channel. The adjustment member is movably receivable within the channel to be seated on the support surface, and to define an adjustment space between the adjustment member and the holder. The adjustment member may thus be adjusted for accommodating a slope and elevation of a ground surface, and sealed with the holder after adjustment.

30 Claims, 15 Drawing Sheets

(56) References Cited

U.S. PATENT DOCUMENTS

| | | | | | |
|---|---|---|---|---|---|
| 4,337,005 | A | | 6/1982 | LeBaron | |
| 4,475,844 | A | | 10/1984 | Arntyr et al. | |
| 4,540,310 | A | | 9/1985 | Ditcher et al. | |
| 4,608,787 | A | * | 9/1986 | Carlson | 52/20 |
| 4,614,065 | A | | 9/1986 | Papp | |
| 4,759,656 | A | * | 7/1988 | Wilson | 404/26 |
| 4,763,449 | A | | 8/1988 | Vigneron et al. | |
| 4,828,274 | A | * | 5/1989 | Stannard | 277/641 |
| 4,925,337 | A | | 5/1990 | Spiess et al. | |
| 5,021,261 | A | * | 6/1991 | Bowman | 427/286 |
| 5,044,818 | A | * | 9/1991 | Pritchard | 404/26 |
| 5,095,667 | A | | 3/1992 | Ryan et al. | |
| 5,211,504 | A | * | 5/1993 | Trudel | 404/26 |
| 5,344,253 | A | | 9/1994 | Sacchetti | |
| 5,360,131 | A | | 11/1994 | Phillipps et al. | |
| 5,362,175 | A | | 11/1994 | Begin | |
| 5,451,119 | A | | 9/1995 | Hondulas | |
| 5,462,386 | A | * | 10/1995 | Prescott | 404/26 |
| 5,470,172 | A | * | 11/1995 | Wiedrich | 404/25 |
| 5,536,110 | A | * | 7/1996 | Tompkins et al. | 404/25 |
| 5,564,855 | A | | 10/1996 | Anderson | |
| 5,702,200 | A | | 12/1997 | Hawkins | |
| 5,944,442 | A | * | 8/1999 | Roush et al. | 404/26 |
| 5,956,905 | A | * | 9/1999 | Wiedrich | 52/20 |
| 5,974,741 | A | * | 11/1999 | Fukuhara | 52/20 |
| 6,044,590 | A | * | 4/2000 | Gagas | 52/20 |
| 6,109,824 | A | | 8/2000 | Annés | |
| 6,161,984 | A | * | 12/2000 | Sinclair | 404/25 |
| 6,311,433 | B1 | | 11/2001 | Zdroik | |
| 6,344,137 | B1 | * | 2/2002 | Chiang | 210/164 |
| 6,350,081 | B1 | | 2/2002 | Khajavi et al. | |
| 6,371,687 | B1 | | 4/2002 | Heintz et al. | |
| 6,381,775 | B1 | | 5/2002 | Sondrup | |
| 6,385,913 | B1 | | 5/2002 | Ahn | |
| 6,435,764 | B1 | | 8/2002 | McNeely | |
| 6,457,901 | B1 | | 10/2002 | Sondrup | |
| 6,514,008 | B1 | | 2/2003 | Smolnik | |
| 6,520,713 | B2 | | 2/2003 | Sondrup | |
| 6,524,026 | B2 | * | 2/2003 | Sondrup | 404/26 |
| 6,595,717 | B2 | * | 7/2003 | Newman | 404/26 |
| 6,613,228 | B2 | | 9/2003 | Petersen et al. | |
| 6,692,183 | B2 | | 2/2004 | Godfrey | |
| 6,695,526 | B2 | | 2/2004 | Sondrup | |
| 6,698,973 | B2 | | 3/2004 | Suatac | |
| 6,743,088 | B2 | | 6/2004 | Closkey | |
| 6,752,565 | B2 | | 6/2004 | Schrage | |
| 6,799,920 | B2 | | 10/2004 | Sondrup | |
| 6,811,350 | B2 | * | 11/2004 | Nadasde | 404/26 |
| 6,948,287 | B2 | | 9/2005 | Korn | |
| 6,955,499 | B2 | | 10/2005 | Sondrup | |
| 7,150,580 | B1 | * | 12/2006 | Ess | 404/26 |
| 7,163,352 | B2 | * | 1/2007 | Jurich et al. | 404/25 |
| 7,401,998 | B2 | * | 7/2008 | Wilson et al. | 404/26 |
| 2002/0150424 | A1 | * | 10/2002 | Brodeur | 404/26 |
| 2004/0040221 | A1 | | 3/2004 | Airheart | |
| 2004/0120762 | A1 | | 6/2004 | Sondrup | |
| 2005/0058505 | A1 | | 3/2005 | Nadasde | |

OTHER PUBLICATIONS

European Search Report for EP 09175733.6, dated May 8, 2012.

* cited by examiner

INTEGRATED FRAME AND COVER SYSTEM

CROSS-REFERENCE TO RELATED APPLICATION

This application is a continuation of U.S. application Ser. No. 12/292,228, filed on Nov. 14, 2008, the entire content of which is incorporated by reference herein.

FIELD

The invention relates in general to manholes, and more particularly to a manhole coupling system for coupling a manhole cover to an underground structure such as a utility box or catch basin.

BACKGROUND

Manholes are frequently constructed in roadways or other surfaces to allow access to underground structures such as sanitary and storm sewers and utility conduits. The structure defining a manhole is defined herein to include an underground utility box or catch basin (herein collectively referred to as a "utility box"), which provides an underground space to allow access to sewers, utility conduits and the like. Also included is structure that functions to couple the utility box to a manhole cover while ideally maintaining it flush with the ground.

In order to preserve the structural integrity of a manhole and the surface material surrounding it, and in order to avoid obstruction to traffic, it is necessary for all underground portions of the manhole to be substantially watertight, and for the manhole cover to be supported flush with the ground. Roadways, for example, are occasionally built on inclines. In order to properly align the manhole cover, it is therefore necessary to adjust the angle of the manhole cover while still maintaining a watertight seal between the manhole cover and the structure coupling it to the manhole, and between the manhole and the roadway.

In addition, roadways must be resurfaced from time to time, resulting in a new layer of paving material being deposited on the old. This leaves the cover below the new pavement level, and necessitates an often costly and time-consuming excavation and adjustment of the manhole to accommodate the manhole cover's height to the new level.

An improperly aligned manhole cover may allow surface water to infiltrate the ground under the roadway, which then buckles or collapses around the manhole cover. Seasonal freezing and thawing of infiltrated water causes expansion and contraction of the ground surrounding the manhole, accelerating its degradation. Misaligned manhole covers also increase the decay of surface material in response to loads such as traffic. This effect can be exacerbated by insufficient compaction of the ground surrounding the manhole, leading to areas of weakness which are more prone to failure.

Various adjustable manholes are described in U.S. Pat. No. 3,858,998 (Larsson et al.), U.S. Pat. No. 5,451,119 (Hondulas), U.S. Pat. No. 5,470,172 (Wiedrich), U.S. Pat. No. 6,109,824 (Armes), U.S. Pat. No. 6,371,687 (Heintz et al.), U.S. Pat. No. 6,520,713 (Sondrup), U.S. Pat. No. 6,695,526 (Sondrup), U.S. Pat. No. 6,799,920 (Sondrup) and U.S. Pat. No. 6,955,499 (Sondrup). Nonetheless, there is still a need for improved systems that are easy to install and are operative to support or retain a manhole cover substantially flush with a ground surface.

SUMMARY

An aspect of the invention provides a manhole coupling system for use in coupling a manhole cover to an underground utility box, the system including a holder having an upper end, a lower end for coupling to an underground utility box, and a channel extending from the upper end to the lower end, the holder further having a support structure extending into the channel and defining an upwardly facing support surface; an adjustment member for coupling to a manhole cover, having an upper end, a lower end, and a passageway extending from the upper end to the lower end, the adjustment member being dimensioned to be movably receivable within the channel at the upper end of the holder to be seated on the upwardly facing support surface, and to define an adjustment space between the adjustment member and the holder when so seated; wherein the passageway is in communication with the channel when the adjustment member is seated on the upwardly facing support surface; and wherein the adjustment member is adjustable relative to the holder for accommodating a slope and elevation of a ground surface, and sealable with the holder after adjustment.

A further aspect of the invention provides a method of coupling a manhole cover to the underground utility box, including providing the holder coupled to the underground utility box; providing the adjustment member for coupling to a manhole cover; inserting a portion of the adjustment member within the channel at the upper end of the holder to be seated on the support surface; and adjusting the adjustment member to accommodate a slope and elevation of a ground surface.

BRIEF DESCRIPTION OF THE DRAWINGS

The invention will be further understood with reference to the detailed description and the drawings, in which.

DETAILED DESCRIPTION

Figure 1:
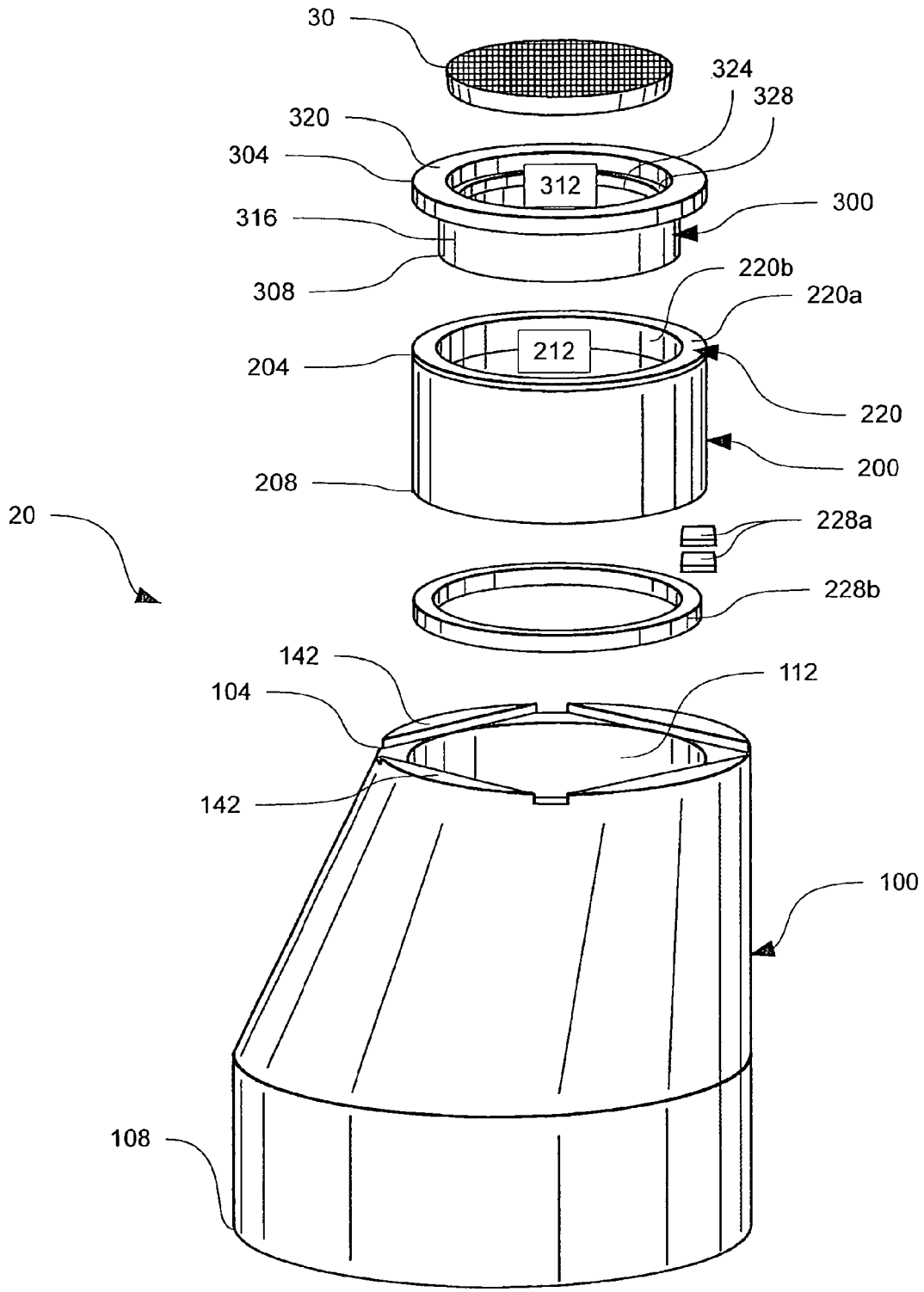
FIG. 1 is an exploded isometric view of a manhole coupling system, according to a non-limiting embodiment, and a manhole cover.

Referring now to FIG. 1, a manhole coupling system, according to a non-limiting embodiment, is indicated generally at 20. Manhole coupling system 20 is used to couple a manhole cover 30 to an underground utility box (not shown) and includes a holder 100, an adjustment member 200 and a floating member 300. Manhole cover 30 may be any of a variety of manhole covers known in the art, and is understood not to be an element of manhole coupling system 20. In use, holder 100 is placed in the ground atop an underground utility box. A portion of adjustment member 200 is then inserted within holder 100 to rest on an upwardly facing support surface, as will be described below. Adjustment member 200 is then adjusted, as will be described below, to accommodate a slope and elevation of a ground surface (not shown). A portion of floating member 300 is then inserted within adjustment member 200, and manhole cover 30 is supported by floating member 300. Thus, manhole cover 30 is coupled to the underground utility box by manhole coupling system 20 in a way that allows for easy slope and elevation adjustment.

Figure 2:
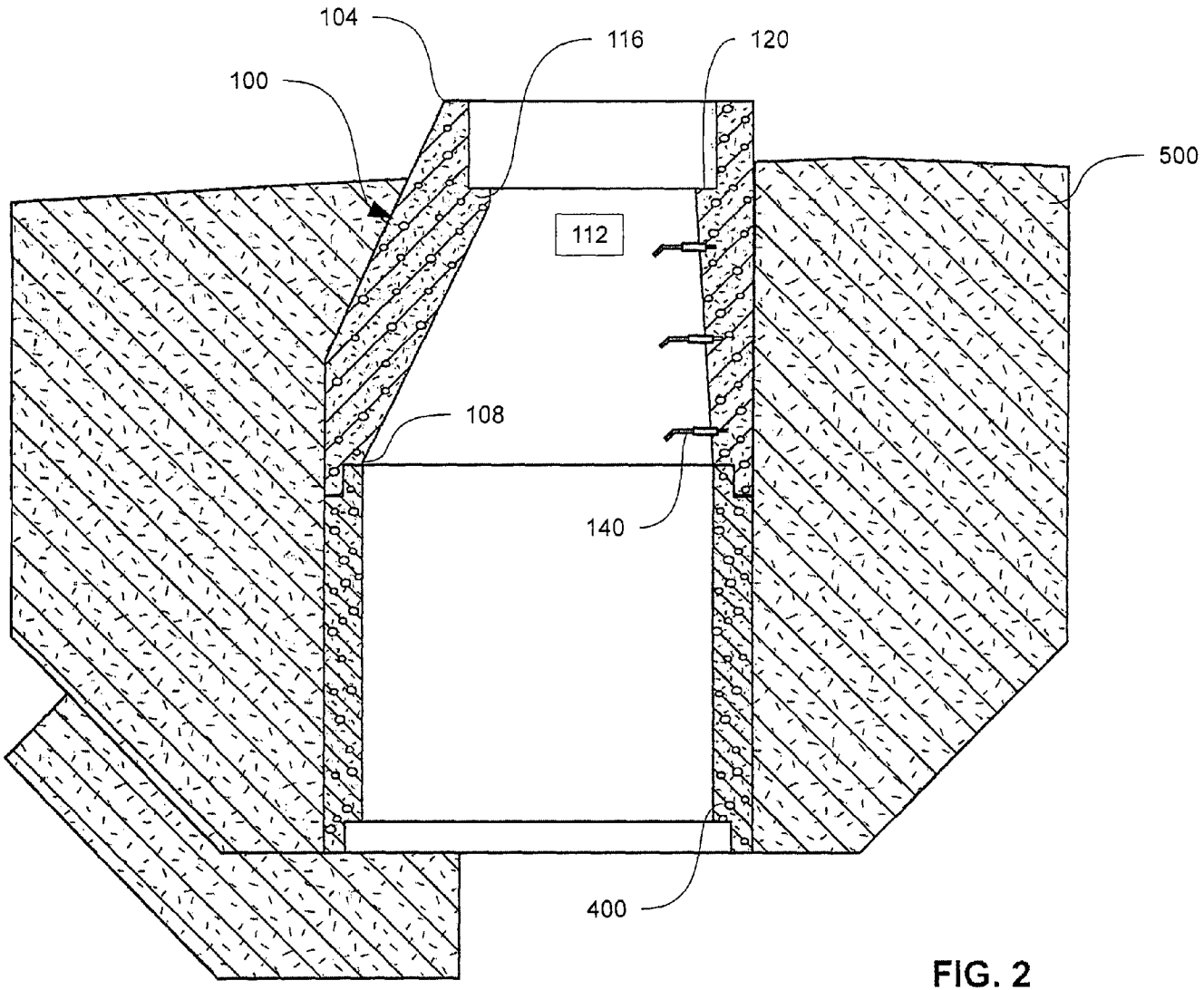
FIGS. 2-12 are sectional elevational views depicting the installation of the manhole coupling system of FIG. 1 in the ground, according to one non-limiting method.

The installation of manhole coupling system 20 will now be described in detail with reference to FIG. 1 and to FIGS. 2-12, which depict the installation of manhole coupling system 20 according to the embodiment depicted in FIG. 1 in a roadway. With reference to FIGS. 1 and 2, holder 100 is a generally tapered, hollow structure with a substantially circular cross-section in a horizontal plane. In FIG. 2, holder 100 is provided coupled to an underground utility box 400 embedded in backfill material 500. Utility box 400 is of a type well known in the art, and defines an underground space allowing access to underground sanitary and storm sewers, and utility conduits. Backfill material 500, as will be appreciated by persons skilled in the art, was initially excavated (not shown) to expose or if necessary, to install, utility box 400. Backfill material 500 was then replaced around utility box 400 and holder 100, once holder 100 was coupled to utility box 400. Holder 100 includes an upper end 104, a lower end 108 for coupling to underground utility box 400, and a substantially cylindrical channel 112 extending substantially vertically from upper end 104 to lower end 108. Channel 112 is preferably dimensioned to allow entry by a worker (not shown) to access utility box 400. Holder 100 further includes a support structure 116 extending into channel 112 and defining an upwardly facing support surface 120. In this embodiment, support structure 116 extends into channel 112 substantially continuously around channel 112 in the form of a substantially circular lip or rim. Support surface 120 is defined by the top of support structure 116, and may be substantially horizontal and therefore substantially perpendicular to the wall of channel 112 from which it extends. In this embodiment support structure 116 is integrally formed with holder 100, for example as a monolithic concrete cast.

It will be understood that any reference in the specification to "upper" and "lower" elements are made in relation to the manhole coupling system in the installed state. As shown in FIG. 2, therefore, upper end 104 of holder 100 is the end which, when installed, will be located towards the surface of a roadway or the like. Similarly, lower end 108 of holder 100 is the end which, when installed in the ground, will be located away from the surface of a roadway or the like, towards utility box 400. In more general terms, as manholes are used to access underground elements from above ground, "upper" will be understood to mean further from the earth's core, while "lower" will be understood to mean closer to the earth's core.

Similarly, the terms "vertical" and "horizontal" will be understood in relation to the installed system as depicted in the drawings. Furthermore, references in the specification to "inwardly" and "outwardly" and associated terms are made in relation to the installed manhole coupling system. "Inwardly" will be understood to mean towards the centre of the system in a plane substantially parallel to a ground surface—towards the centre of channel 112 in a horizontal plane, for example—while outwardly will be understood to be the opposite direction, away from the centre of the system.

Lower end 108 of holder 100 is coupled to utility box 400 by known means. Lower end 108 of holder 100 preferably substantially matches the upper end of utility box 400 in horizontal cross-section in order to provide a close, watertight fit between holder 100 and utility box 400. Holder 100 may also include one or more steps 140 for easier descent towards utility box 400 when access is necessary. When holder 100 is coupled to utility box 400, as shown in FIG. 2, channel 112 communicates with the interior of utility box 400 to allow access to utility box 400 from upper end 104 of holder 100.

Figure 3:
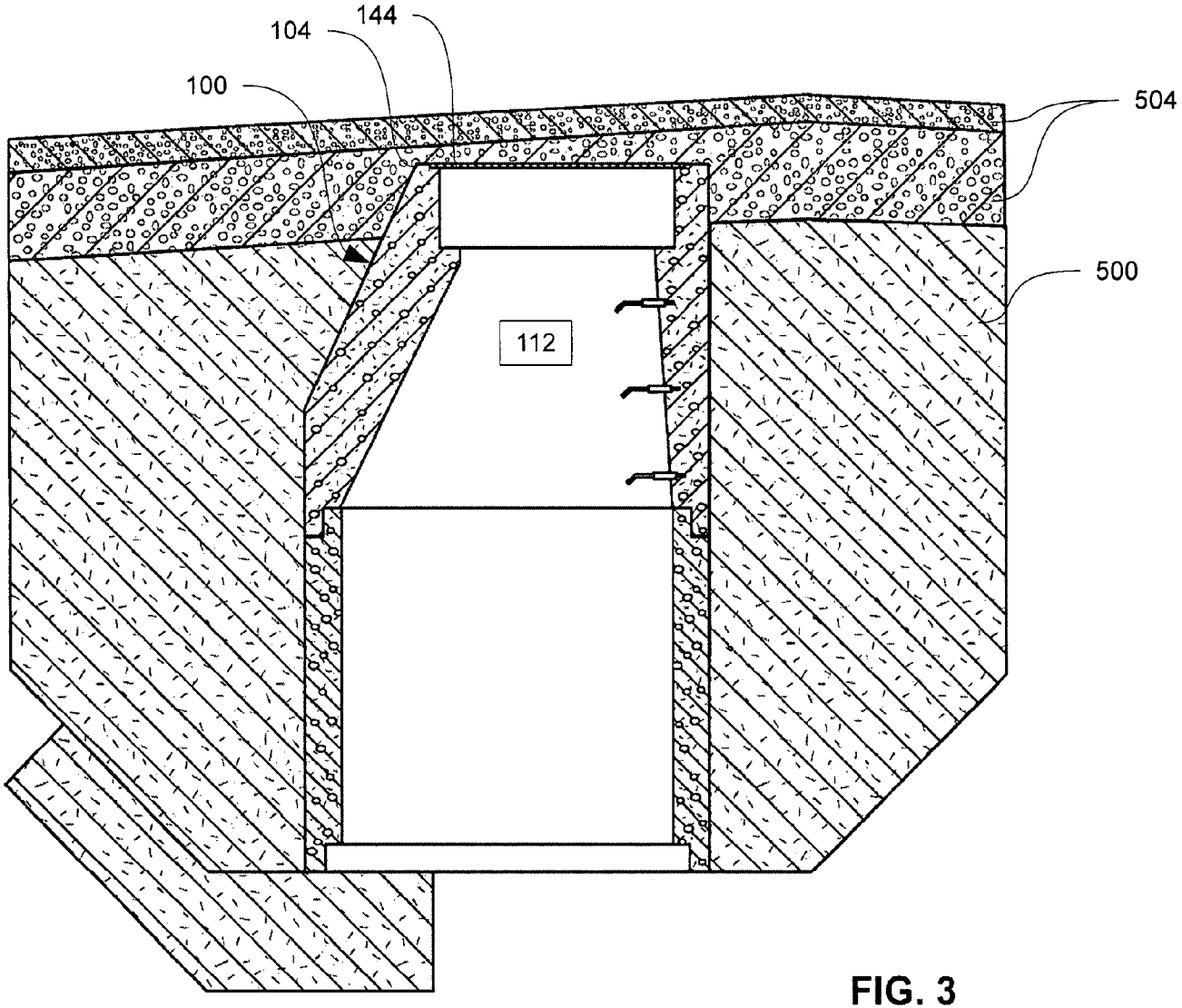

In this embodiment, as can be seen in FIG. 1, holder 100 includes four upstanding walls 142 extending upwardly from upper end 104, with inner edges substantially tangential to channel 112. Upstanding walls 142 define between them a substantially rectangular space at upper end 104 of holder 100. Referring now to FIG. 3, a plate 144 is placed over channel 112 at upper end 104 of holder 100. Plate 144 fits between upstanding walls 142, into the rectangular space therebetween. Thus, plate 144 lies against upper end 104 and substantially flush with the tops of upstanding walls 142. Subgrade material 504 is then placed over backfill material 500 and plate 144, and then leveled and compacted to provide a desired subgrade slope. Plate 144 prevents entry of subgrade material 504 into channel 112 during the leveling and compacting operations, and allows subgrade material 504 to be placed, leveled and compacted without requiring any special care near holder 100, thus avoiding any inadequate compaction surrounding holder 100. In this embodiment, plate 144 is a rectangular steel plate capable of withstanding compaction and the weight of subgrade material 504.

Figure 4:
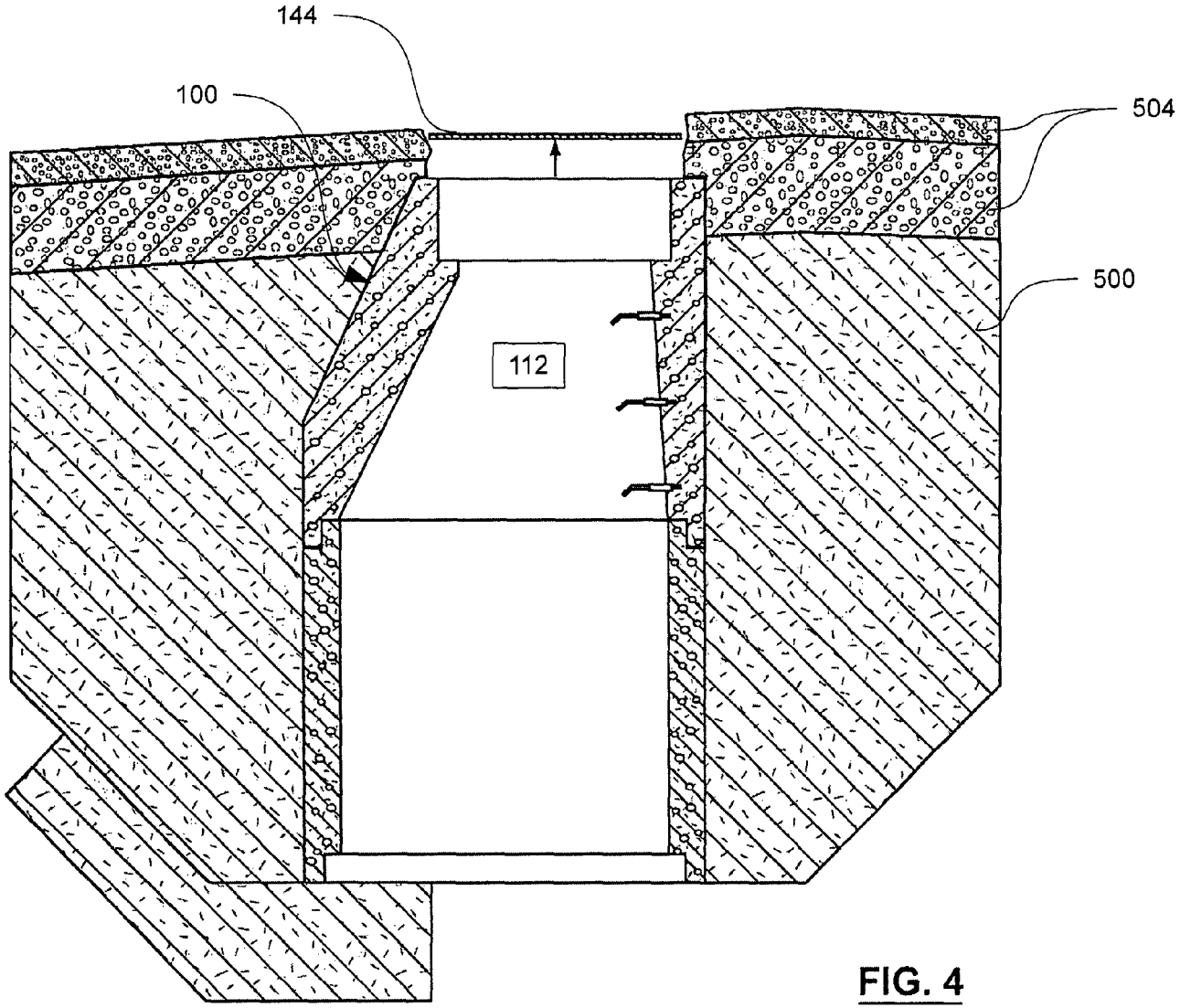

Referring to FIG. 4, a portion of subgrade material 504 is removed and plate 144 is lifted from holder 100 to expose channel 112 and allow for the installation of additional components of manhole coupling system 20, as will be described below.

Figure 5:
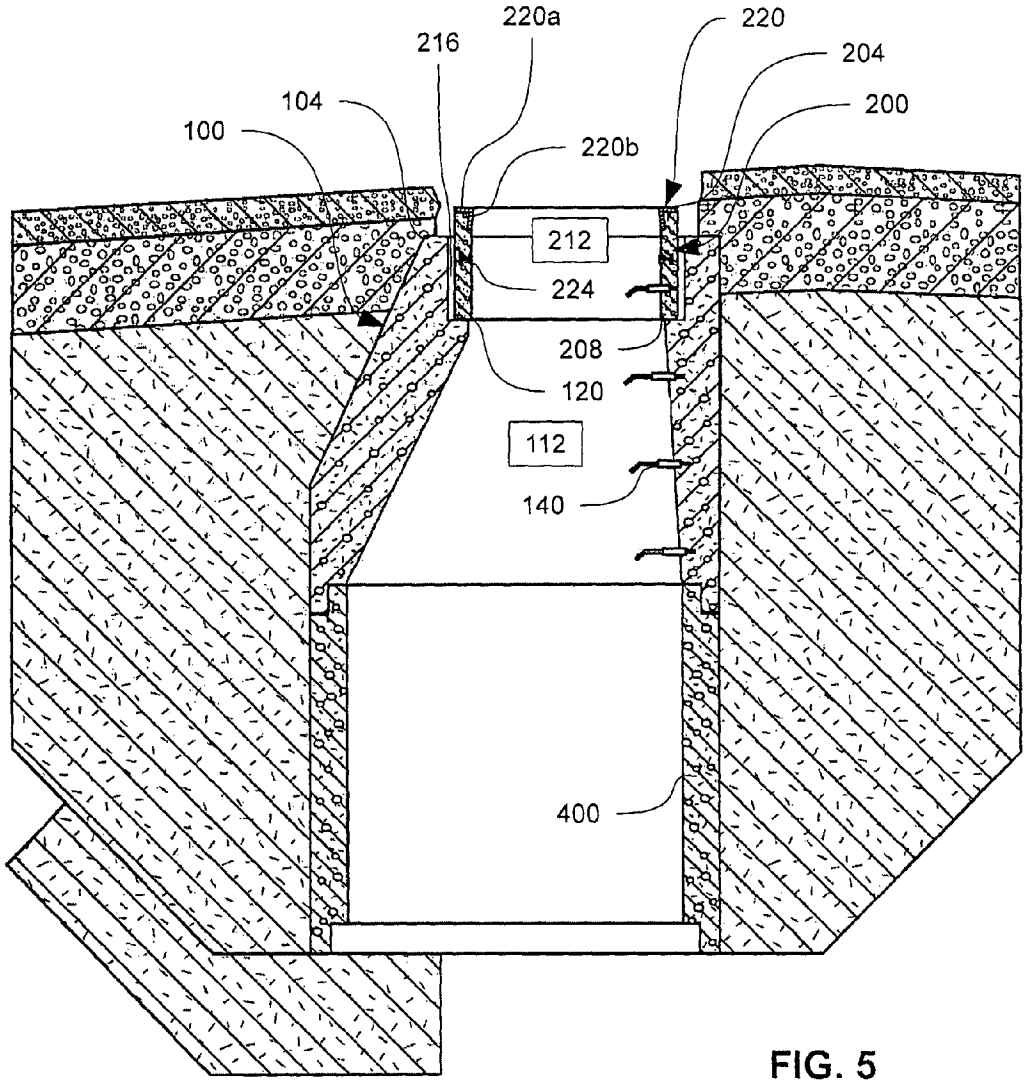

With reference to FIG. 5, a portion of adjustment member 200 is inserted within channel 112 at upper end 104 of holder 100. As can be seen in FIGS. 1 and 5, adjustment member 200 in this embodiment is a tubular element with a substantially circular horizontal cross section. Adjustment member 200 is for coupling to a manhole cover—in this embodiment, the coupling is made via floating member 300—and includes an upper end 204, a lower end 208 and a substantially cylindrical passageway 212 extending substantially vertically from upper end 204 to lower end 208. Adjustment member 200 is adjustable relative to holder 100 to accommodate a slope and elevation of a ground surface (not shown), and is sealable with holder 100 after adjustment, as will be described below. Adjustment member 200 is dimensioned to be movably receivable within channel 112, such that when so received as depicted in FIG. 5, lower end 208 of adjustment member 200 is seated on upwardly facing support surface 120. Movement of adjustment member 200 within channel 112 is allowed by an adjustment space 216 defined between adjustment member 200 and holder 100 upon insertion of adjustment member 200. In this embodiment, adjustment member 200 has an outer diameter that is smaller than the diameter of channel 112, thus defining adjustment space 216 as an annular space around adjustment member 200. Adjustment space 216 allows adjustment member 200 to move within channel 112 vertically and horizontally, and also allows adjustment member 200 to be tilted within channel 112. Additionally, adjustment member 200 may include one or more steps 140 as shown in FIG. 5 to ensure that easy access is provided to utility box 400.

Adjustment member 200 further includes a passageway insert 220 in the form of a steel or cast iron rim extending substantially continuously around upper end 204 of adjustment member 200. Passageway insert 220 is attached to adjustment member 200, though the two elements as depicted in FIGS. 1 and 5 are not integrally formed of the same material. In this embodiment, passageway insert 220 is cast into adjustment member 200 during the manufacture of adjustment member 200. Passageway insert 220 includes an upper portion 220*a* overlaying upper end 204 of adjustment member 200 as well as an inner portion 220*b* depending downwardly into passageway 212 from upper portion 220*a*. Passageway insert 220 provides increased strength and dimensional stability to adjustment member 200, resulting in a better fit between adjustment member 200 and floating member 300, as will be discussed below with reference to FIG. 7. Inner portion 220*b* preferably sits flush with the wall of passageway 212, and acts to reduce friction between adjustment member 212 and floating member 300. Additionally, adjustment member 200 may include a plurality of anchors 224, as depicted in FIG. 5. Anchors 224 are well known in the art for removably coupling to chains or other suitable suspension mechanisms (not shown), thus allowing adjustment member 200 to be lifted and moved by known means.

Figure 6:
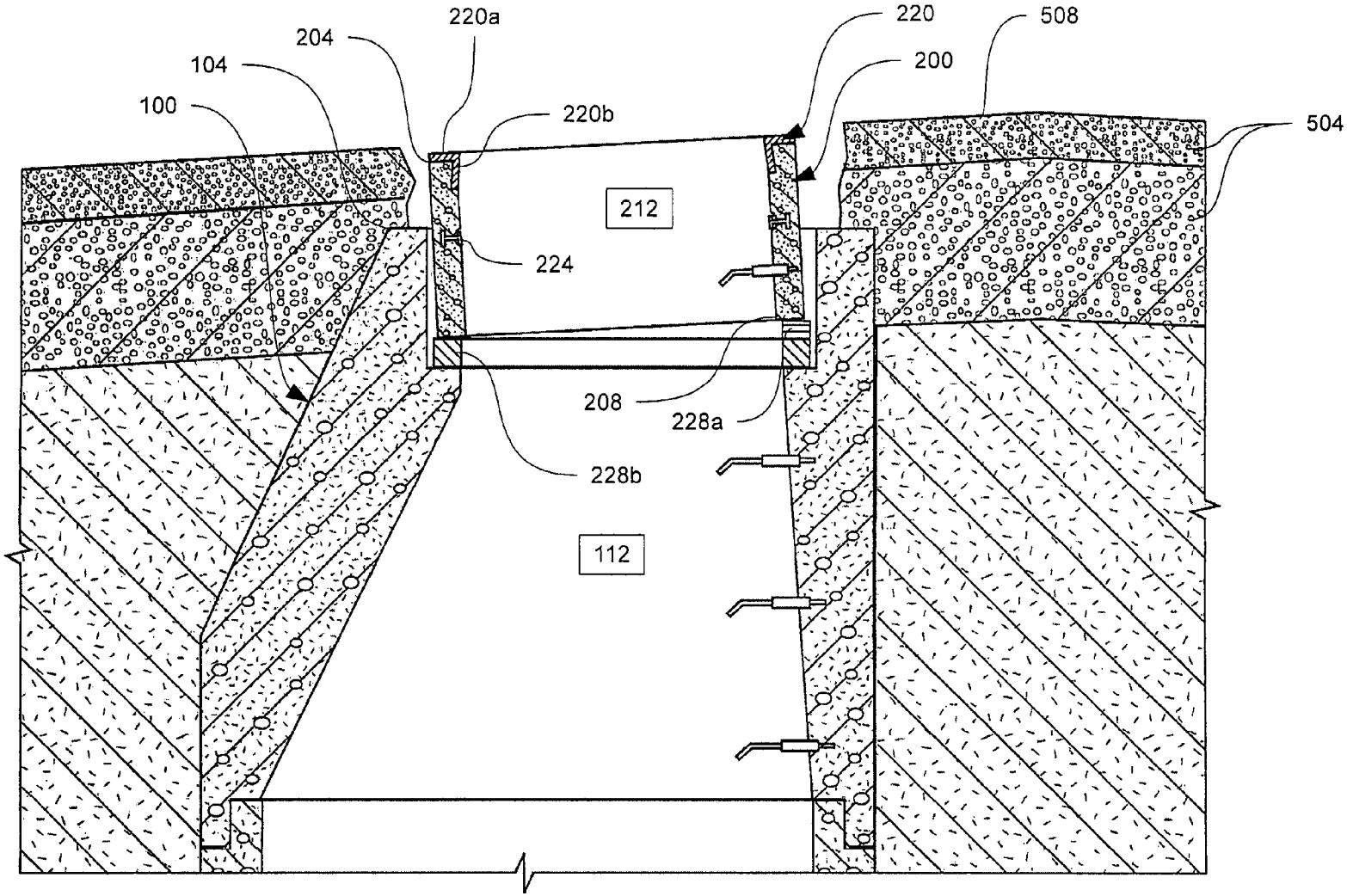

Referring now to FIG. 6, adjustment member 200 is adjusted within channel 112 to accommodate a desired slope and elevation of a ground surface of the roadway (not shown). It will be appreciated that while this ground surface, which is defined as the final, paved surface of the roadway, is not yet in place and therefore not illustrated in FIG. 6, such a ground surface will be substantially parallel to a surface 508 of subgrade material 504. In order to accommodate an elevation of a ground surface, it will be understood that adjustment member 200 may be adjusted within channel 112 to a level which will place any remaining components of manhole coupling system 20 at the elevation necessary to support manhole cover 30 flush with a ground surface, when that surface is in place. Accommodating the slope of a ground surface may be achieved by inclining upper end 204 of adjustment member 200 to be substantially parallel to the angle of surface 508 of subgrade material 504, which will in turn be substantially parallel to the angle of a ground surface as described above.

Adjustment is achieved by insertion of one or more spacers between lower end 208 of adjustment member 200 and upwardly facing support surface 120. For angular adjustments, the spacers may be shims 228*a*, which may be generally rectangular pieces of material of varying thicknesses. In this embodiment, shims 228*a*, as is well known in the art, are rectangular plastic elements. One or more shims 228*a* are inserted between adjustment member 200 and support surface 120 on the side of adjustment member 200 needing to be raised (the right side, as seen in FIG. 6). Where uniform adjustments to elevation are desired, the spacers may be grade adjustment rings 228*b*. Grade adjustment rings 228*b* are also well known in the art, and in this embodiment are annular concrete elements having a shape similar to that of support structure 116 of holder 100. It will be appreciated that a combination of shims 228*a* and grade adjustment rings 228*b* may be used to obtain the desired adjustment for adjustment member 200. As a result of adjusting adjustment member 200 as shown in FIG. 6, at least a portion of adjustment member 200 is placed above upper end 104 of holder 100 and at an angle that is substantially parallel to the angle of surface 508.

Preferably, when both shims 228*a* and grade adjustment rings 228*b* are used, grade adjustment rings 228*b* are placed on upwardly facing support surface 120, as shown in FIG. 6, before shims 228*a* in order to prevent the generation of stress concentrations in grade adjustment rings 228*b*.

Figure 7:
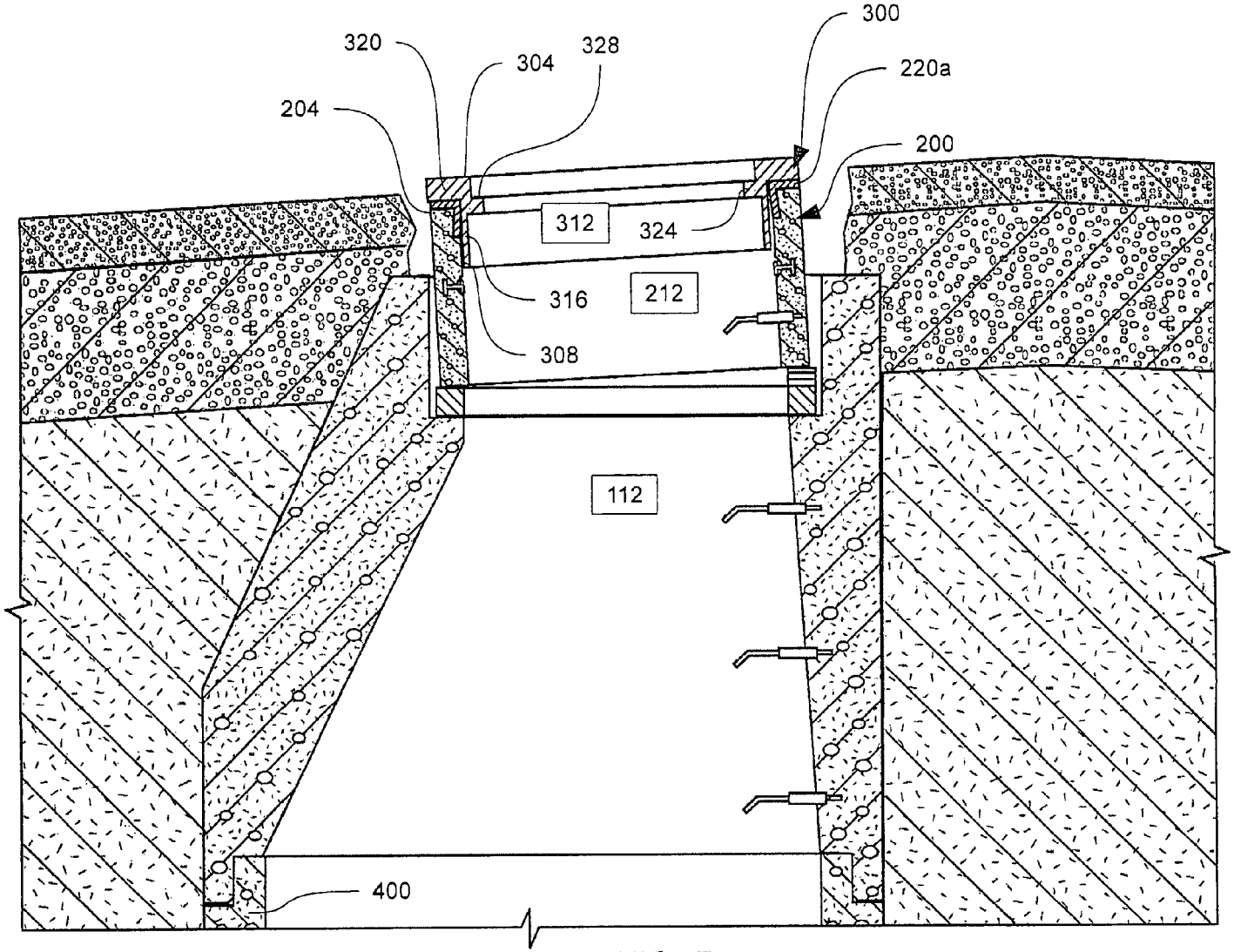

With reference to FIG. 7, once adjustment member 200 is adjusted to the desired elevation and slope within channel 112, a portion of floating member 300 is inserted within passageway 212 at upper end 204 of adjustment member 200. As depicted in FIGS. 1 and 7, floating member 300 includes an upper end 304, a lower end 308 and an access opening 312 extending from upper end 304 to lower end 308. In this embodiment, a sliding portion 316 of floating member 300 extends downwardly from an engagement member 320, and is a hollow cylindrical element dimensioned to be slideably receivable within passageway 212. Sliding portion 316 is dimensioned such that the fit between sliding portion 316 and passageway 212 permits sliding motion—that is, motion substantially parallel to the walls of passageway 212—but as little other motion such as tilting and the like, as possible. Such a fit allows floating member 300 to move in a desired manner—that is, to "float" substantially perpendicularly with a ground surface, as will be seen below—while maintaining a seal between floating member 300 and adjustment member 200 to prevent entry of water and debris. When sliding portion 316 is received within passageway 212, access opening 312 and passageway 212 are in communication as depicted in FIG. 7, to provide access to utility box 400 from upper end 304 of floating member 300.

Engagement member 320 of floating member 300, in this embodiment, is a circular flange extending outwardly above sliding portion 316. Engagement member 320 has an outer diameter that is larger than the inner diameter of passageway 212. As a result engagement member 320, upon installation of sliding portion 316 within passageway 212, engages or rests upon upper portion 220*a* of passageway insert 220 to prevent floating member 300 from simply falling through passageway 212.

Floating member 300 also includes a manhole cover support structure 324, which defines an upwardly facing cover support surface 328. As shown in FIGS. 1 and 7, manhole cover support structure 324 is in the form of a circular flange extending into access opening 312 from the upper end of sliding portion 316. Manhole cover support structure 324 may support manhole cover 30 over access opening 312 and substantially flush with a ground surface (not shown). Preferably, the distance between upwardly facing cover support surface 328 and upper end 304 of floating member 300 is equal to the thickness of manhole cover 30, such that upon complete installation of manhole coupling system 20, manhole cover 30 and the top of engagement member 320 are maintained flush with a ground surface (not shown).

As can be seen in FIGS. 1 and 7, sliding portion 316, engagement member 320 and manhole cover support structure 324 may all be integrally formed, for example from a single piece of steel or cast iron.

Figure 8:
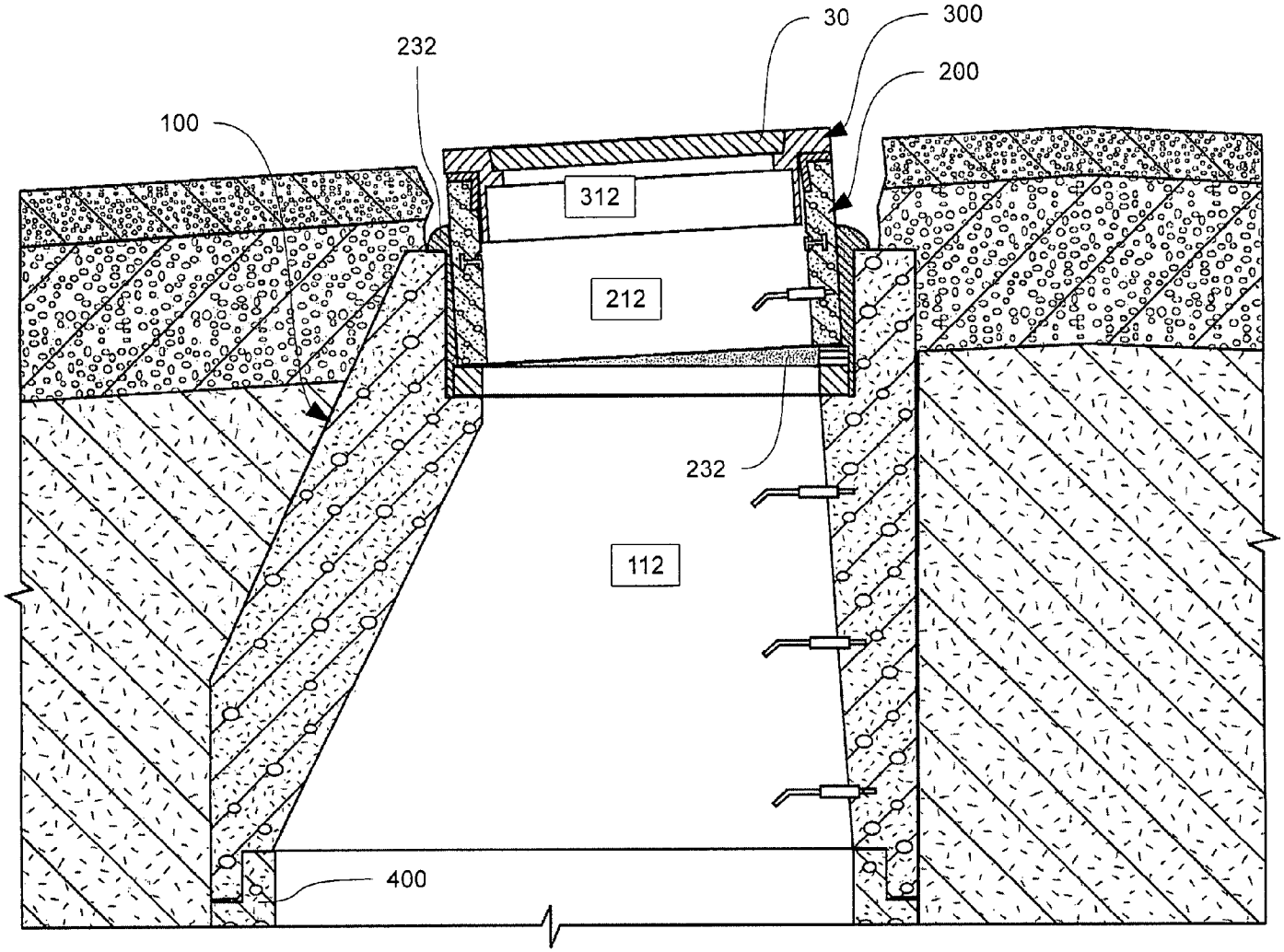

With reference to FIG. 8, adjustment member 200 is sealed within channel 112 of holder 100 after adjustment is complete. It will be understood that adjustment member 200 may also be sealed before insertion of floating member 300. Sealing is achieved by insertion of sealing material 232 within adjustment space 216. Preferably, sealing material 232, which in this embodiment is non-shrink grout, is inserted substantially continuously around adjustment member 200 in order to fill as much of adjustment space 216 as possible. This fixes holder 100 and adjustment member 200 to each other as a single structure and provides an effective seal, preventing entry of subgrade material 504, water and the like into channel 112 from adjustment space 216. Sealing material 232 may be installed by known methods. One such method requires the use of a rubber sleeve (not shown) placed within passageway 212 and channel 112 to press against the walls thereof. Sealing material 232 may then be inserted into adjustment space 216 and will be prevented from falling into utility box 400 by the rubber sleeve. Once sealing material 232 has set or dried as necessary, the rubber sleeve may be removed for reuse elsewhere.

Manhole cover 30 may be placed on upwardly facing cover support surface 328 as shown in FIG. 8. Additionally, if the elevation of adjustment member 200 within channel 112 has been increased significantly (not shown), one or more additional steps 140 may be placed directly in sealing material 232 to provide easy access to utility box 400 from upper end 304 of floating member 300.

Figure 9:
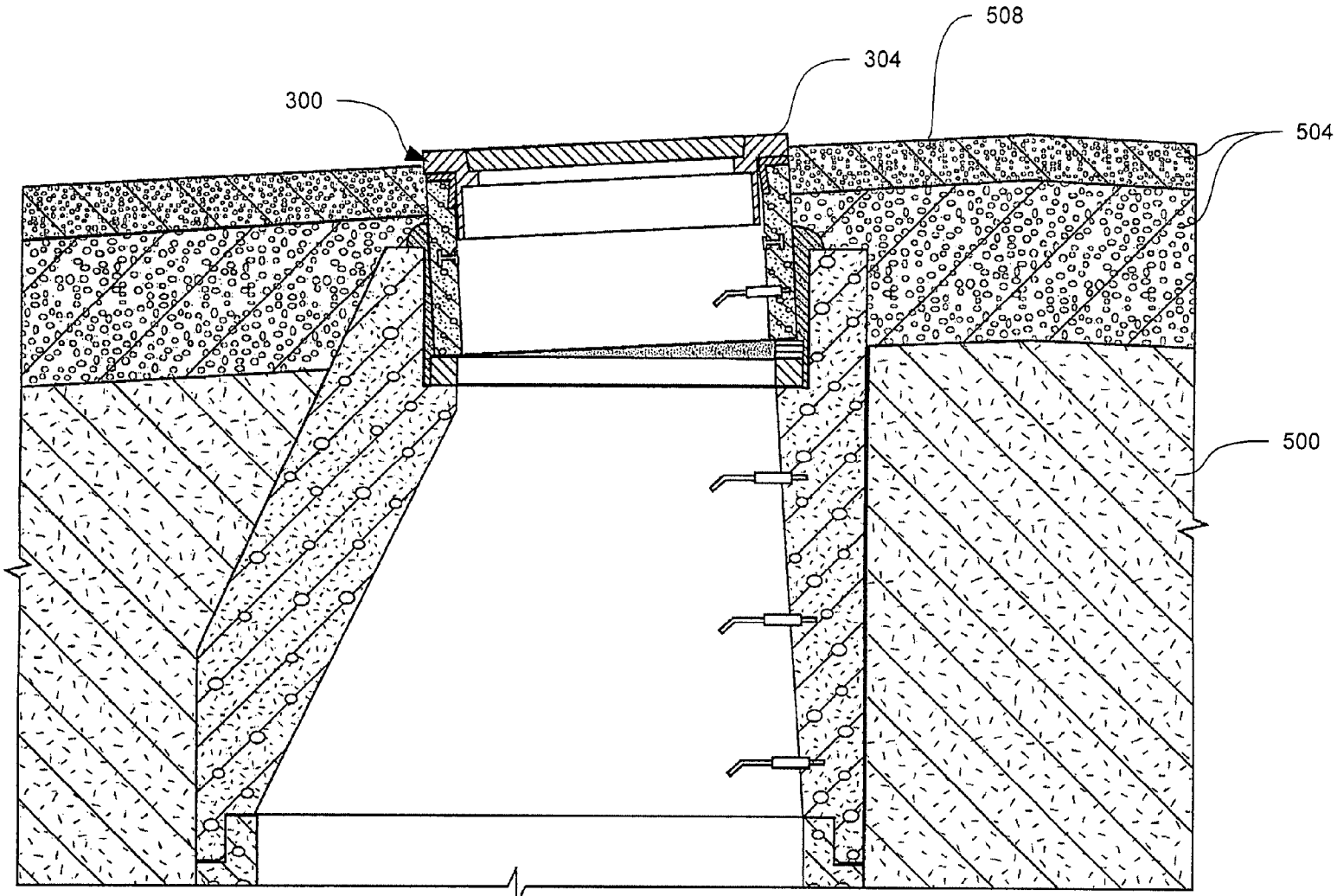

Referring to FIG. 9, some of the portion of subgrade material 504 that was excavated earlier with reference to FIG. 4 is replaced and compacted around manhole coupling system 20. It will be noted that following the compaction of subgrade material 504, upper end 304 of floating member 300 is maintained above surface 508 of subgrade material 504. This is to provide for the addition of further surface material, as will be discussed below.

Figure 10:
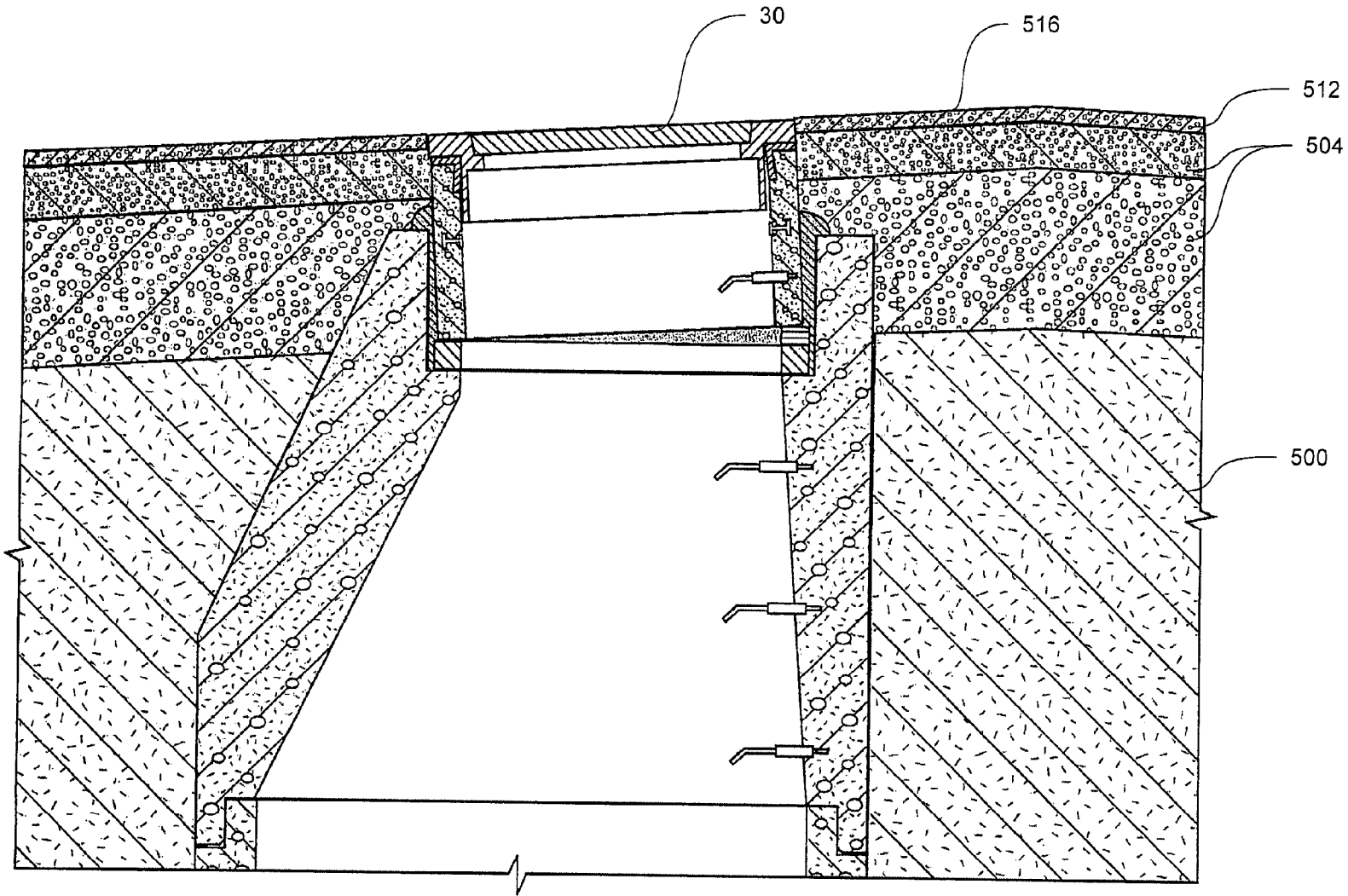

With reference to FIG. 10, a ground surface material such as base asphalt layer 512 is placed over subgrade material 504. As a result, manhole cover 30 is supported substantially flush with a surface 516 of base asphalt layer 512. Base asphalt layer 512 may be used if the roadway is being constructed in an area where heavy construction traffic likely to damage the roadway will be present for a time, such as a greenfield sub-development or the like. Base asphalt layer 512 provides a functional roadway for such traffic, and following the cessation of construction traffic, a final asphalt layer (not shown) may be installed, as will be described with reference to FIGS. 11 and 12.

Figure 11:
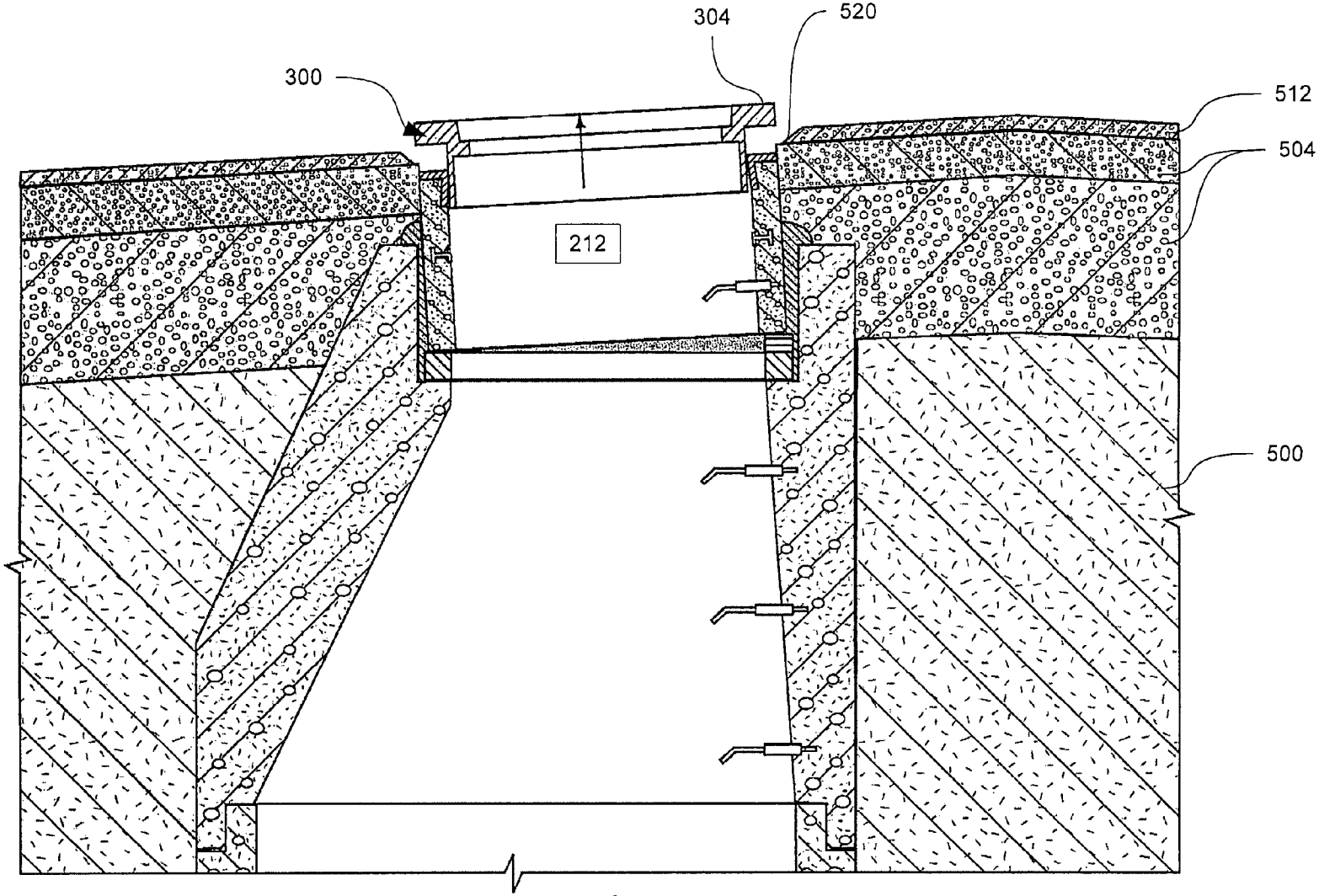

Referring now to FIG. 11, preparations are made for the placing of a final layer of asphalt (not shown). A band is removed from base asphalt layer 512 to form an angled edge 520 of base asphalt layer 512 surrounding upper end 304 of floating member 300. Floating member 300 may then be lifted within passageway 212 to a desired elevation at which it will support manhole cover 30 substantially flush with the surface of a final layer of asphalt (not shown). Manhole cover 30 is not shown in FIG. 11, as it may be necessary to remove manhole cover 30 in order to adjust the elevation of floating member 300.

Figure 12:
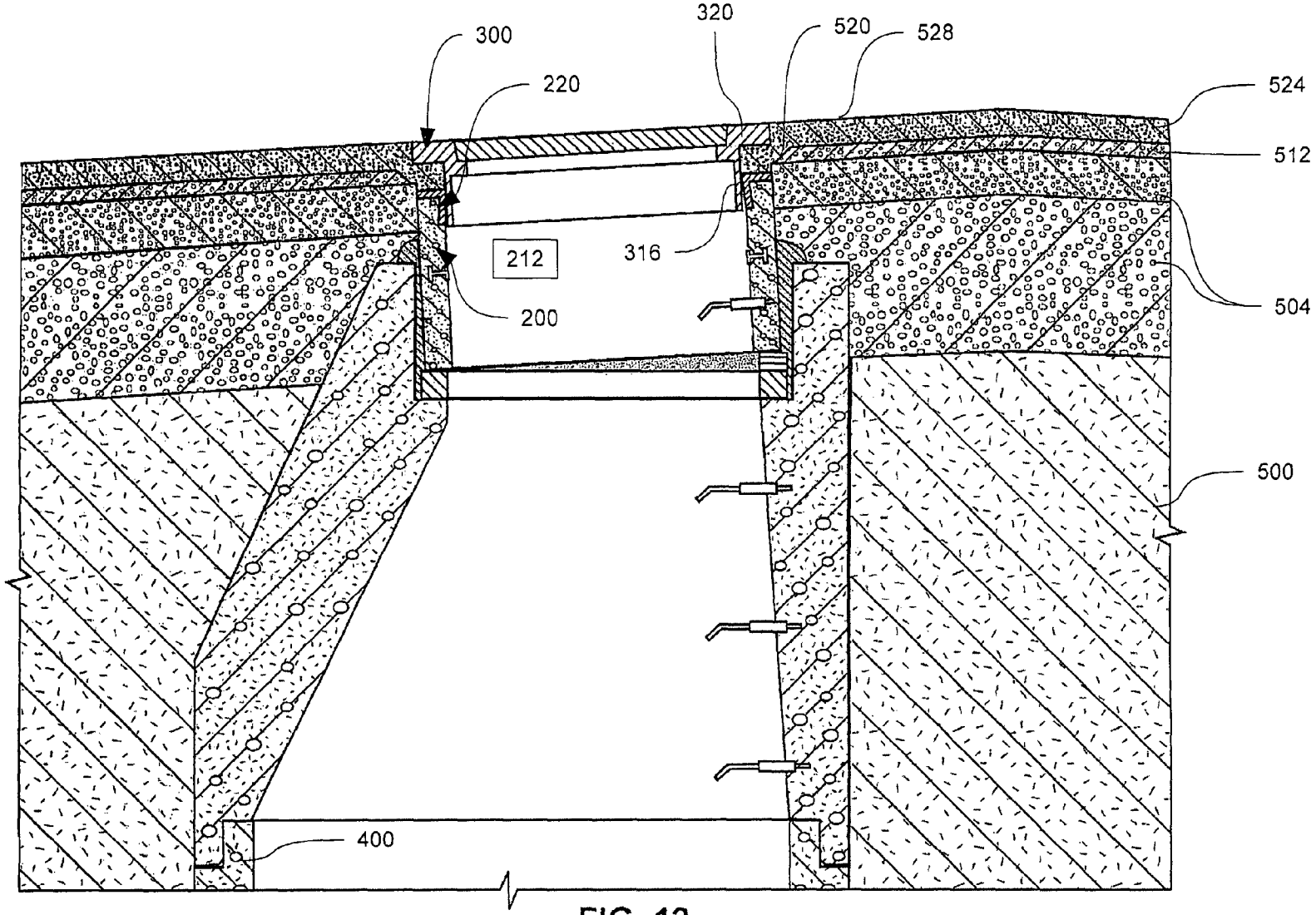

With reference to FIG. 12, a final asphalt layer 524 or other ground surface material defining a ground surface 528 is placed over base asphalt layer 512. A portion of final asphalt layer 524 flows below engagement member 320 of floating member 300. Angled edge 520 of base asphalt 512 allows the portion of final asphalt layer 524 to flow more easily under engagement member 320. Engagement member 320 now engages ground surface material in final asphalt layer 524 instead of upper end 204 of adjustment member 200. This engagement allows floating member to slide within passageway 212 in response to movement of final asphalt layer 524, as will be described below.

Once final asphalt layer 524 is in place, it may be compacted. It will be noted that compaction may occur equally over all of final asphalt layer 524. There is little need to exercise special care around manhole cover 30 and upper end 304 of floating member 300, because floating member 300 is free to slide within passageway 212 in response to such compaction while still maintaining a seal with adjustment member 200. Following compaction, cover 30 will be coupled to utility box 400 and supported substantially flush with ground surface 528.

In addition to sliding in response to compaction during the installation of final asphalt layer 524, floating member 300, by way of engagement member 320, may also slide within passageway 212 in response to other movement, such as that caused by seasonal expansion and contraction of asphalt or other ground surface material. Movement of ground surface material exerts a force on engagement member 320, and causes floating member 300 to slide within passageway 212. Passageway insert 220 helps maintain a close fit between adjustment member 200 and floating member 300, and reduces friction between floating member 300 and passageway 212. The improved dimensional stability provided by passageway insert 220, coupled with the reduced friction, allow for an improved seal between floating member 300 and adjustment member 200.

It will be noted that the placement of base asphalt layer 512 may be omitted if it is deemed unnecessary. This may be the case, for example, in a municipal roadway where a final surface is desired immediately. In such a situation, base asphalt layer 512 may be omitted and final asphalt layer 524 may be placed directly on subgrade material 504. It will also be noted that the above process may be repeated if resurfacing of a roadway or other surface is required. Floating member 300 may simply be supported at a new elevation, and a new layer of ground surface material may be placed. Sliding portion 316 of floating member 300 may be manufactured in varying lengths, capable of accommodating greater or smaller adjustments in elevation.

It will be appreciated by persons skilled in the art, in light of the above description, that the manufacture of holder 100 and support structure 116 as depicted in FIGS. 1-12 may be achieved by modifying a known existing tapered structure (not shown) by providing an enlarged opening near upper end 104 so as to define support structure 116 without altering the outside dimensions of holder 100. This approach allows the continued use of existing equipment and processes for producing such tapered structures. Additionally, walls 142 may be used with existing rectangular cover support frames (not shown) which merely rest on top of holder 100, allowing holder 100 to be used with existing manhole structures if desired.

A person skilled in the art will appreciate that variations may be made to the above embodiment without departing from the scope of the invention. For example, utility box 400 may also include one or more steps 140 to provide easier access. Floating member 300 may also include one or more steps 140, for instance if floating member 300 extends far enough into passageway 212 to warrant the addition of steps. Steps 140 may additionally be adjustable steps, or any other suitable type of step known in the art. Further, plate 144 need not be a rectangular steel plate, as described. Any other suitable covering capable of withstanding compaction and the weight of subgrade material 504 may also be used, with corresponding alterations made to upstanding walls 142 to match the chosen shape of plate 144. Shims **228*a* and grade adjustment rings 228*b* may also vary in shape and construction. Suitable materials include plastic, concrete and the like, and shims 228*a* may, for instance, be tapered (not shown) if so desired, to allow for adjustment of the slope of adjustment member 200 while maintaining greater surface contact with both lower end 108 and support surface 120. Sealing material, while described above as a non-shrink grout, may also be replaced with other suitable materials known to persons skilled in the art. Other components, such as floating member 300** and its constituent parts, may also be constructed of any suitable material, in addition to those already mentioned, known to those skilled in the art.

Figure 13A:
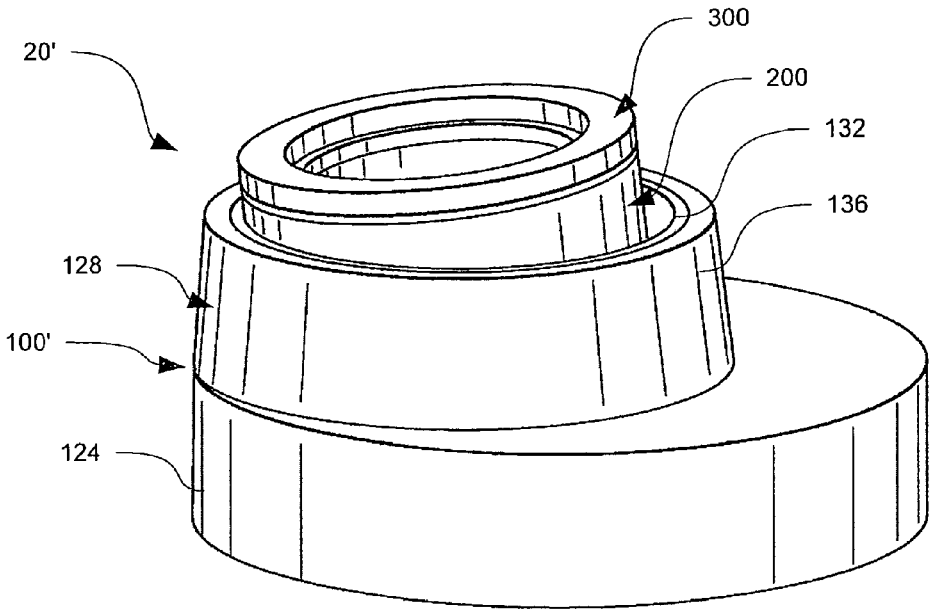
FIGS. 13A and 13B are isometric and sectional elevational views, respectively, of a manhole coupling system, according to a second non-limiting embodiment.
Figure 13B:
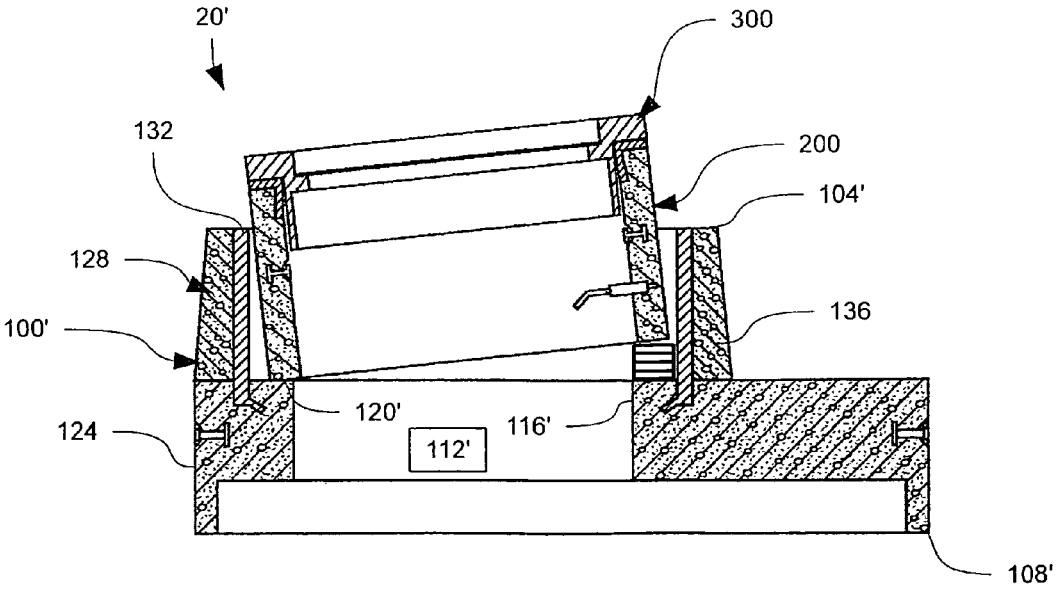

In a second embodiment, depicted in FIGS. 13A and 13B, a manhole coupling system 20' is provided for coupling a manhole cover (not shown) to an underground utility box (not shown). Manhole coupling system 20' is useful, for example, when the distance between an underground feature to which access is desirable, and a ground surface such as the surface of a roadway, is too short to allow the use of manhole coupling system 20 described above with reference to FIGS. 1-12. Manhole coupling system 20' includes a holder 100', an adjustment member 200 and a floating member 300. Adjustment member 200 and floating member 300 are as described above with reference to FIGS. 1-12.

As depicted in FIGS. 13A and 13B, a holder 100' includes an extension 124 and a collar 128. Extension 124 is a hollow substantially cylindrical structure, which in this embodiment is made of concrete. Collar 128 includes an upstanding tubular steel or cast iron sleeve 132 surrounded by a tubular, tapered jacket 136. Extension 124 and collar 128 both define substantially vertical openings therethrough, and the bottom of collar 128 is coupled to the top of extension 124 as shown in FIG. 13B such that the openings communicate with each other. Thus, holder 100' has an upper end 104' defined by the top of collar 128, and a lower end 108' defined by the bottom of extension 124. Holder 100' further includes a channel 112' extending between upper end 104' and lower end 108' of holder 100'. Channel 112' is defined by the communicating openings through extension 124 and collar 128. In this embodiment, collar 128 is coupled to extension 124 by casting sleeve 132 directly into the top of extension 124.

In this embodiment, the diameter of the opening through extension 124 is smaller at the top of extension 124 than the diameter of the opening through collar 128. A support structure 116' extending into channel 112' of holder 100' is therefore defined by the top of extension 124. Support structure 116' provides an upwardly facing support surface 120'.

The installation and adjustment of manhole coupling system 20' is substantially as described above with reference to FIGS. 2-12. Holder 100' is coupled at lower end 108' to a utility box, and adjustment member 200 and floating member 300 are installed and adjusted in the same manner as described previously. Persons skilled in the art will appreciate that the height of holder 100' is smaller than that of holder 100 described earlier, and that manhole coupling system 20' may therefore be suitable in situations where there is little space between an underground utility or the like and a ground surface.

Persons skilled in the art will also appreciate that variations may be made to this embodiment without departing from the scope of the invention. For example, sleeve 132 could instead be bolted or otherwise fastened onto the top of extension 124. This would allow collar 128 to be used with existing structures similar to extension 124, often referred to as "flat top" elements. Additionally, sleeve 132 may be made of other suitable materials, including other metals or plastic. Likewise, jacket 136 and extension 124, which are depicted as concrete elements, may also be made using other suitable materials.

Figure 14B:
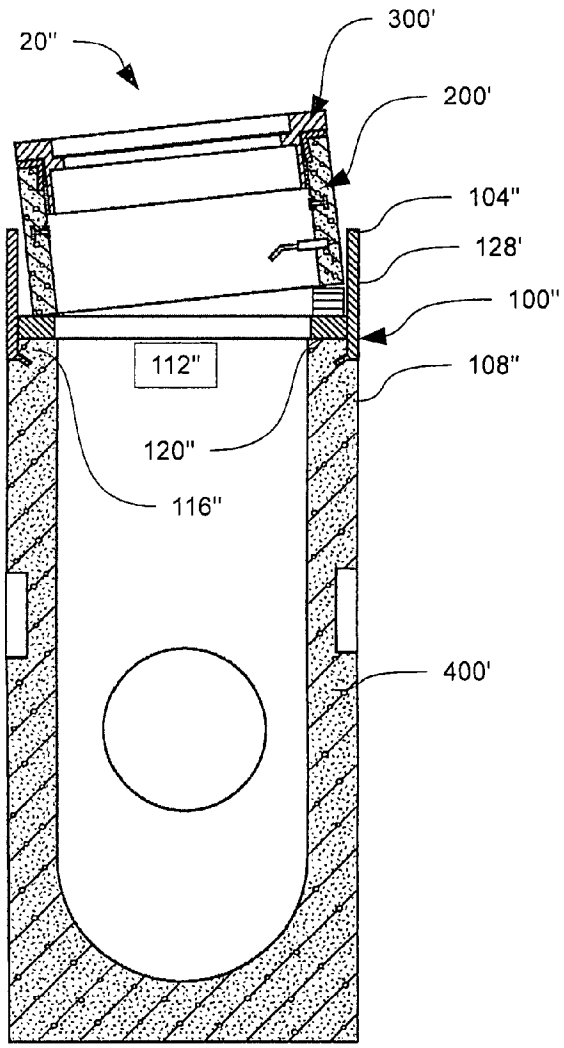
FIGS. 14A and 14B are isometric and sectional elevational views, respectively, of a manhole coupling system, according to a third non-limiting embodiment.
Figure 14A:
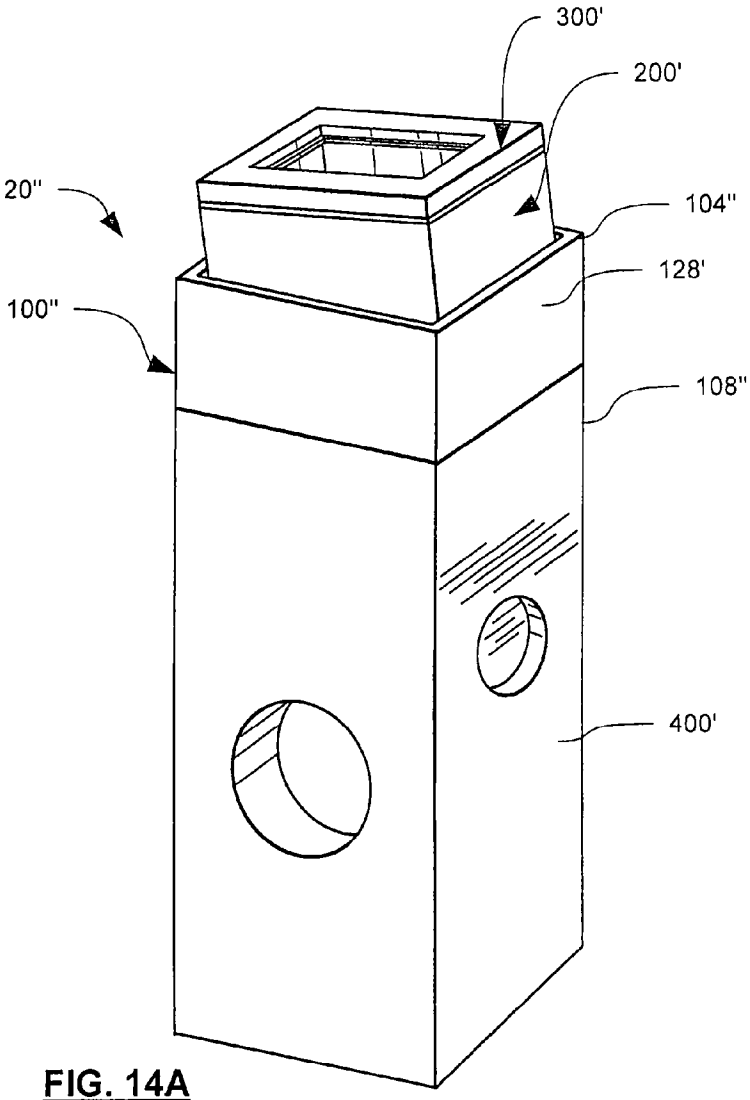

In a third embodiment, depicted in FIGS. 14A and 14B, a manhole coupling system 20" is provided for coupling a manhole cover to an underground utility box. A holder 100" includes an upper portion of a utility box 400' and a collar 128'. Utility box 400' is a hollow, substantially rectangular structure of a type known in the art for use with catch basins. Collar 128' is a substantially rectangular steel or cast iron member, and is coupled to the top of utility box 400'. As with the embodiment depicted in FIGS. 13A and 13B, collar 128' and the upper portion of utility box 400' have substantially vertical openings therein. When collar 128' is coupled to the top of utility box 400', the openings communicate to provide access to the remainder of utility box 400'. Therefore, holder 100" has an upper end 104" defined by the top of collar 128', a lower end 108" defined by the bottom of the upper portion of utility box 400', and a channel 112" extending between upper end 104" and lower end 108". Additionally, holder 100" includes a support structure 116" defining an upwardly facing support surface 120". Support structure 116", similarly to the previous embodiment pictured in FIGS. 13A and 13B, is defined by the upper portion of utility box 400', in which channel 112" is narrower than in collar 128'.

An adjustment member 200' and a floating member 300' are also included in manhole coupling system 20". Adjustment member 200' and floating member 300' are rectangular rather than circular, but are otherwise analogous to adjustment member 200 and floating member 300, respectively, as described above. The installation and adjustment of manhole coupling system 20" is also largely similar to the installation and adjustment described above, with the exception that holder 100" need not be placed in the ground separately after utility box 400', as holder 100" and utility box 400' are integral with each other.

It will be clear to persons skilled in the art that collar 128', while it is shown embedded in the upper portion of utility box 400', may alternatively be coupled to utility box 400' by bolts or other suitable fasteners. This allows an existing utility box to be retro-fitted with collar 128' in order to make use of the present invention.

Figure 15:
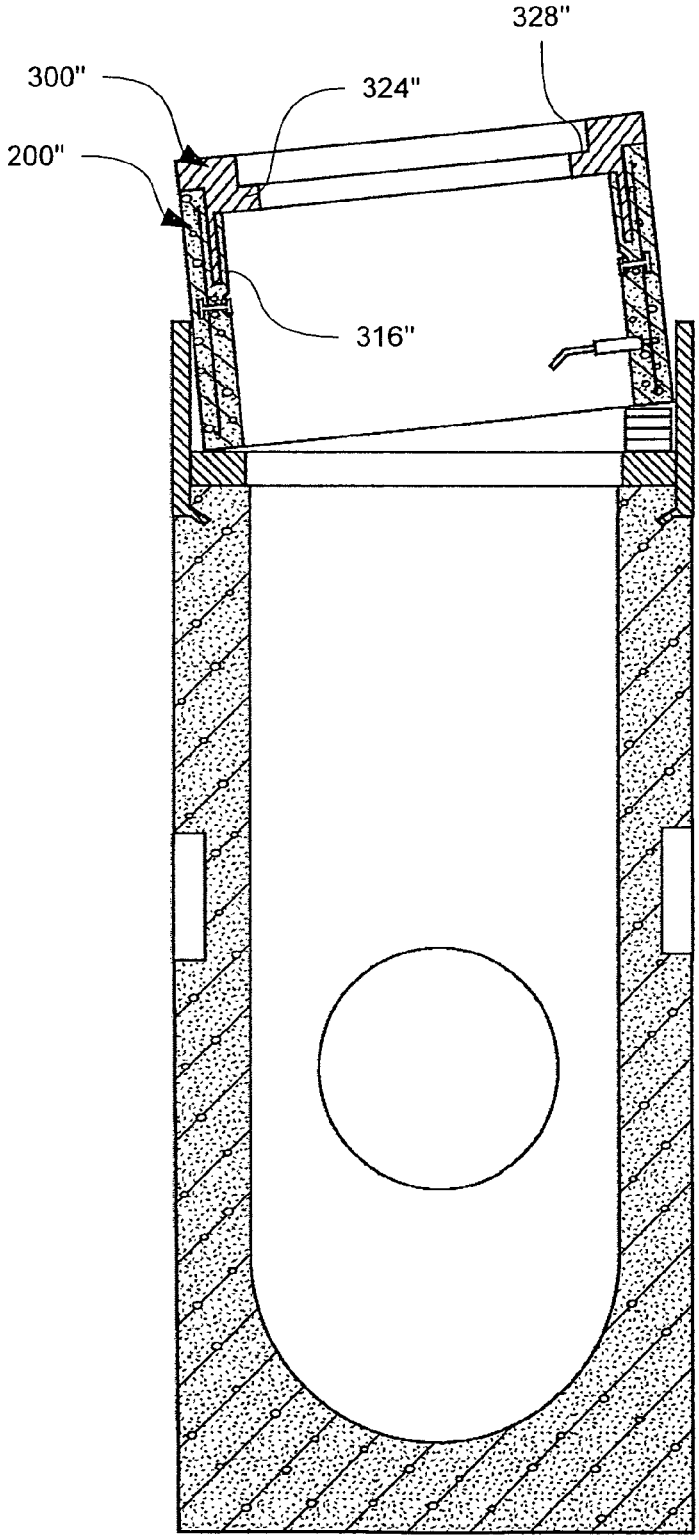
FIG. 15 is a sectional elevational view of a manhole coupling system according to a fourth non-limiting embodiment.

In a fourth embodiment, depicted in FIG. 15, an adjustment member 200" may be provided with an integral cover support structure in the form of a modified floating member 300" which, instead of floating, is embedded in the wall of adjustment member 200". As can be seen in FIG. 15, a wall portion 316", similar in form to sliding portion 316 of floating member 300, is embedded in adjustment member 200", for example by being cast in to adjustment member 200" during the manufacture of adjustment member 200". As such, a cover support structure 324" defining an upwardly facing cover support surface 328" is coupled substantially immovably to adjustment member 200". It will be clear to persons skilled in the art that in the case of this embodiment, the adjustment described with reference to FIG. 11 is not possible.

In addition to the above embodiments, it will be understood that further modifications may be made to manhole coupling system 20. For instance, engagement member 320 is not required to extend substantially continuously around upper end 304 of floating member 300—it may instead be crenellated or sectioned, for example. Likewise, support structure 116 and passageway insert 220 are not required to extend substantially continuously around channel 112 and passageway 212, respectively. The shapes and materials of the various system components and sub-components may be varied as desired. Furthermore, elements described with respect to different embodiments—adjustment member 200" and holder 100, for instance—may be used in conjunction with each other if so desired. Likewise, a collar such as 128 or 128' may be used in conjunction with holder 100 if desired, and a person skilled in the art will appreciate the necessity to reconfigure the shape of the rectangular embodiment of collar 128' for use with a substantially circular structure. The collar could be either embedded within holder 100, or coupled to holder 100 as a retro-fit by way of bolts or other suitable fasteners. While the system has been described with regards to a manhole in a roadway, it may also be applied to similar systems on larger or smaller scales in a wide variety of surfaces.

Persons skilled in the art will appreciate that there are yet more alternative implementations and modifications possible for implementing the embodiments, and that the above implementations and examples are for illustrative purposes only. The scope, therefore, is only to be limited by the claims appended hereto.

What is claimed is:

1. An adjustable manhole cover assembly comprising:

a holder body having a through bore, a lower edge adapted to connect to one or more lower elements to form a manhole and an upper edge having an adjustment member receiving bore adapted to receive an adjustment member in an overlapping relationship, said adjustment member receiving bore including a support structure;

an adjustment member having an inner passageway and having an outer dimension smaller than an inner dimension of said adjustment member receiving bore to permit said adjustment member to permit the height of at least a portion of the adjustment member to be changed when inserted in said adjustment member receiving bore;

one or more spacer elements configured to adjust the angle and/or height of said adjustment member relative to holder body and positioned adjacent said adjustment member on said support structure;

a sealing material located in said receiving bore of said holder body which fixes said holder body and said adjustment member to each other at said adjusted angle and provides a load-bearing connection there between; and a manhole support member carried on an upper end of said adjustment member, said support member including a body a portion of which is sized to be received within said through bore of said adjustment member, and which includes an upper surface adapted to carry a manhole cover, said support member having a through bore coaxial with said through bore of said adjustment member.

2. The adjustable manhole cover assembly of claim 1, further including a manhole cover carried in said manhole support member, wherein said manhole cover can be adjusted in height and/or slope to be substantially flush with a surrounding roadway surface by adjusting a height and angle of said adjustment member within said holder body, without adjusting a position of said holder body.

3. The adjustable manhole cover assembly of claim 1, wherein said support structure extends into said through bore substantially continuously around the through bore.

4. The adjustable manhole cover assembly of claim 1, wherein said holder body and said adjustment member define an adjustment space therebetween.

5. The adjustable manhole cover assembly of claim 4, wherein said adjustment space contains said sealing material.

6. The adjustable manhole cover assembly of claim 5, wherein said sealing material comprises grout.

7. The adjustable manhole cover assembly of claim 1, further including a floating member having an upper end and a lower end which define an upper through bore having an outer dimension smaller that an inner dimension of said adjustment member through bore to permit said floating member to be inserted into said adjustment member.

8. The adjustable manhole cover assembly of claim 7 wherein said floating member is dimensioned to be flush with a finished grade of a roadway.

9. The adjustable manhole cover assembly of claim 7, wherein said floating member includes a flange extending outwardly to engage said adjustment member.

10. The adjustable manhole cover assembly of claim 1, wherein the positioning of spacer elements create a space between said holder body and said adjustment member to receive said sealing material.

11. The adjustable manhole cover assembly of claim 7, wherein said floating member includes a manhole cover support structure for receiving said manhole cover.

12. The adjustable manhole cover assembly of claim 1, wherein said holder is integrally formed with said manhole.

13. The adjustable manhole cover assembly of claim 1, wherein said support structure is defined by an upper edge of a lower element of said manhole.

14. The adjustable manhole cover assembly of claim 1, wherein said manhole defines an underground utility box.

15. The adjustable manhole cover assembly of claim 1, wherein said assembly further includes at least one grade adjustment ring between a support surface defined by the top of said support structure and said adjustment member.

16. The adjustable manhole cover assembly of claim 1, wherein said adjustment member includes a plurality of lifting anchors accessible through said inner passageway to facilitate placing said adjustment member in said holder body.

17. The adjustable manhole cover assembly of claim 1, wherein said adjustment member further includes at least one ladder rung extending into said inner passageway.

18. The adjustable manhole cover assembly of claim 1 further comprising a removable sleeve barrier to prevent the sealing material from falling into said manhole.

19. An adjustable manhole cover assembly comprising:

a holder body having a through bore, a lower edge adapted to connect to one or more lower elements to form a manhole and an upper edge having an adjustment member receiving bore adapted to receive an adjustment member in an overlapping relationship;

said adjustment member having a through bore and having an outer dimension smaller than an inner dimension of said adjustment member receiving bore to permit the height of at least a portion of the adjustment member to be changed when inserted in said adjustment member receiving bore;

one or more spacer elements configured to adjust the angle and/or height of said adjustment member relative to said holder body and positioned adjacent said adjustment member;

a sealing material located in said receiving bore of said holder body which provides a seal between said holder body and said adjustment member;

a manhole support member carried on an upper end of said adjustment member, said support member including a body a portion of which is sized to be received within said through bore of said adjustment member, and which includes an upper surface adapted to carry a manhole cover, said support member having a through bore coaxial with said through bore of said adjustment member; and a manhole cover carried in said manhole support member, wherein said manhole cover can be adjusted in height and/or slope to be substantially flush with a surrounding roadway surface by adjusting a height and angle of said adjustment member within said holder body, without adjusting a position of said holder body.

20. The adjustable manhole cover assembly of claim 19, wherein said sealing material comprises a load-bearing material.

21. The adjustable manhole cover assembly of claim 19, wherein said sealing material comprises grout.

22. The adjustable manhole cover assembly of claim 19, further including a floating member having an upper end and a lower end which define a through bore having an outer dimension smaller than an inner dimension of said adjustment member to permit said floating member to be inserted into said adjustment member.

23. The adjustable manhole cover assembly of claim 22, wherein said floating member includes a flange extending outwardly to engage said adjustment member.

24. The adjustable manhole cover assembly of claim 22, wherein said floating member includes a manhole support structure for receiving said manhole cover.

25. An adjustable manhole cover assembly comprising:

a holder body having a through bore, a lower edge adapted to connect to one or more lower elements to form a manhole and an upper edge having an adjustment member receiving bore adapted to receive an adjustment member in an overlapping relationship;

said adjustment member having a through bore and having an outer dimension smaller than an inner dimension of said adjustment member receiving bore to permit said adjustment member to permit the height of at least a portion of the adjustment member to be changed when inserted in said adjustment member receiving bore;

one or more spacer elements configured to adjust the angle and/or height of said adjustment member relative to said holder body and positioned adjacent said adjustment member;

a material located in said receiving bore of said holder body which fixes said holder body and said adjustment member to each other at said adjusted angle; and a manhole support member carried on an upper end of said adjustment member, said support member including a body a portion of which is sized to be received within said through bore of said adjustment member, and which includes an upper surface adapted to carry a manhole cover, said support member having a through bore coaxial with said through bore of said adjustment member.

26. The adjustable manhole cover assembly of claim 25, further including a manhole cover carried in said manhole support member, wherein said manhole cover can be adjusted in height and/or slope to be substantially flush with a surrounding roadway surface by adjusting a height and angle of said adjustment member within said holder body, without adjusting a position of said holder body.

27. The adjustable manhole cover assembly of claim 25, wherein said material which fixes said holder body to said adjustment member comprises a load-bearing material.

28. The adjustable manhole cover assembly of claim 25, wherein said material which fixes said holder body to said adjustment member comprises grout.

29. The adjustable manhole cover assembly of claim 25, further including a floating member having an upper end and a lower end which define a through bore having an outer dimension smaller than an inner dimension of said adjustment member to permit said floating member to be inserted into said adjustment member.

30. The adjustable manhole cover assembly of claim 29, wherein said floating member includes a manhole support structure for receiving said manhole cover.

* * * * *